US005210899A

United States Patent [19]

Goldstein et al.

[11] Patent Number: 5,210,899

[45] Date of Patent: May 18, 1993

[54] PAINT ROLLER BEARINGS

[75] Inventors: Edward J. Goldstein; Richard A. Linn, both of Minneapolis; Wade H. Krinke, Marine on St. Croix, all of Minn.

[73] Assignee: Padco, Inc., South East Minneapolis, Minn.

[21] Appl. No.: 765,304

[22] Filed: Sep. 25, 1991

[51] Int. Cl.[5] ..... B05C 17/02

[52] U.S. Cl. ..... 15/230.11; 492/13; 492/19

[58] Field of Search ..... 15/230.11; 29/110.5, 29/116, 120, 129

[56] References Cited

U.S. PATENT DOCUMENTS

| | | | |
|---|---|---|---|
| D. 291,152 | 8/1987 | Bay . | |
| 2,669,742 | 2/1954 | Coughlan | 15/230.11 |
| 2,747,210 | 5/1956 | Canning | 15/230.11 |
| 2,854,684 | 10/1958 | Hardman . | |
| 3,228,087 | 1/1966 | Stoddavt | 29/116 |
| 3,386,119 | 6/1968 | Shulman | 15/193 |
| 3,447,184 | 6/1969 | McGinley | 15/230.11 |
| 3,711,887 | 1/1973 | Chapman | 15/230.11 |
| 3,877,123 | 4/1975 | Pharris | 15/230.11 |
| 3,986,226 | 10/1976 | Roe et al. | 15/230.11 |
| 4,209,883 | 7/1980 | Hawk | 15/230.11 |
| 4,263,690 | 4/1981 | Dobosi | 15/230.11 |
| 4,316,031 | 2/1982 | Smith | 15/230.11 |

FOREIGN PATENT DOCUMENTS

| | | | |
|---|---|---|---|
| 3903519 | 8/1990 | Fed. Rep. of Germany | 15/230.11 |
| 2593725 | 8/1987 | France | 15/230.11 |

*Primary Examiner*—Edward L. Roberts
*Attorney, Agent, or Firm*—Jacobson & Johnson

[57] ABSTRACT

A paint roller bearing with offsetting core support surface for use in small diameter paint roller applicators that permit the user to change a paint roller quickly and efficiently on a paint roller applicator, with the bearing having an axle-engaging member that clamps to the axle of a paint roller frame to rotatably secure the bearing to the axle of a paint roller frame. The paint roller bearing offset surfaces permit molding the bearing using in inexpensive open and shut molding process while still providing a central opening in the bearing. An alternative embodiment includes friction ridges to hold a paint roller core on the bearing.

24 Claims, 6 Drawing Sheets

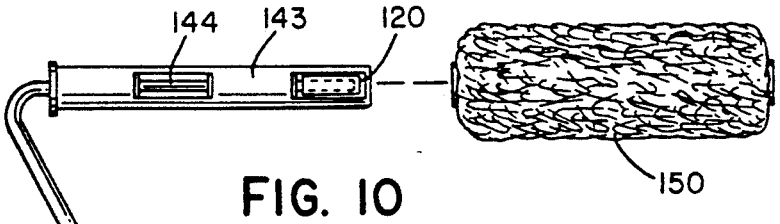
FIG. 10
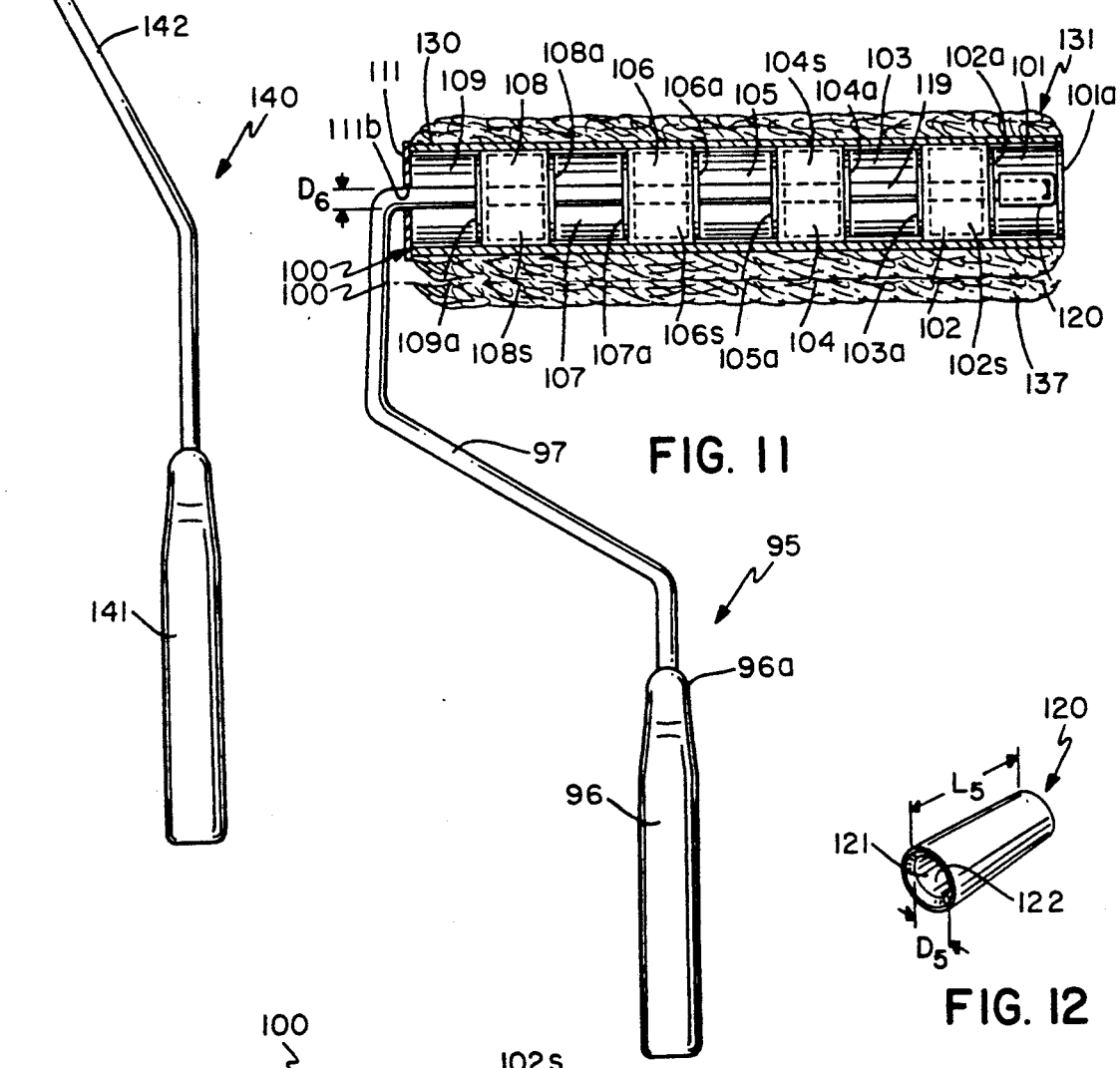
FIG. 11
FIG. 12
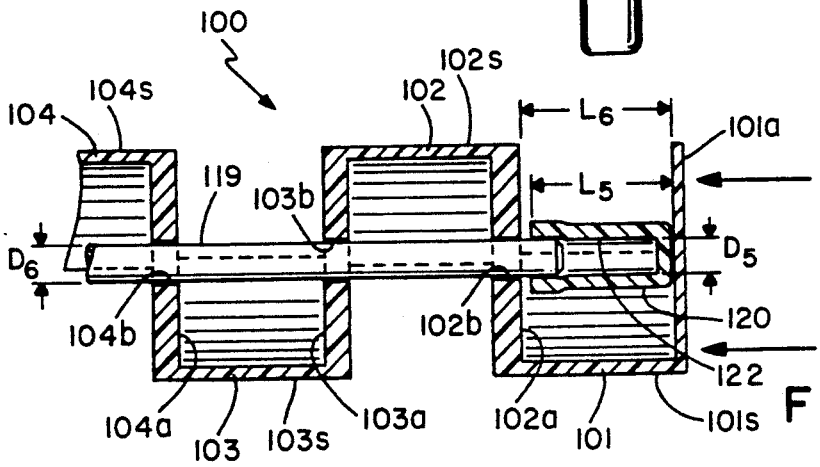
FIG. 13

PAINT ROLLER BEARINGS

FIELD OF THE INVENTION

This invention relates to paint roller applicators and, more specifically, to improvements to paint roller bearings and methods of making paint roller bearings.

BACKGROUND OF THE INVENTION

The concept of paint roller applicators is well known in the art. In general, a paint roller applicator includes a frame with a handle for a user to grasp the applicator and an absorbent cover or roller rotatably mounted on the end of the frame to permit a user to roll paint onto a surface. The need for frequently removal of rollers for cleaning necessitates their mounting on a wire cage-bearing mechanism through a friction fit between the wire cage bearing and the interior core of the paint roller. The friction fit allows a user to slip the roller on or off manually. This procedure works well for large-diameter paint rollers, such as the conventional one-and-one-half inch diameter paint rollers.

One of the difficulties with manufacturing small-diameter paint rollers for use in tight places is that the bearing must also have a small diameter. Unfortunately, decreasing typical wire cage-bearing mechanisms, which are usually about one- and one-half inches in diameter, to a smaller diameter is both difficult and costly.

Also, a smaller sized bearing mechanism may not properly hold the paint roller in a rotatable position on the frame of the paint roller applicator unless the tolerances necessary to produce a slide fit between the roller and the bearing also decrease. Generally, the tolerances for frictional fit between the core and the bearing become increasingly critical as the diameter of the paint roller core decreases. Without careful control, the fit of the paint roller on the bearing may be incorrect—either too tight or too loose. Closely controlling tolerances of wire bearings increases their manufacturing costs.

In general, paint roller applicators are relatively inexpensive. For consumer acceptance, component costs must be low. One method of reducing costs is injection molding of bearings out of plastics. The small degree of working pressure applied to bearings permits their manufacture from inexpensive grades of plastic. However, molding the bearings from inexpensive, weaker plastics has two drawbacks. First, the need to assemble the bearing on an axle usually requires force, necessitating the use of more expensive, stronger plastics.

Second, plastic injection molds are very costly and complex. To achieve internal holes or undercuts in more than one plane requires incorporation of slides, cores or other means into an injection mold. This greatly increases the cost and the required maintenance on the mold. The best design for a plastic part requires a mold without complex slides or cores. Unfortunately, the bearings require a central opening and other irregular features, making molding of plastic bearings expensive. Consequently, manufacturing plastic paint roller bearings with an axial opening requires additional labor costs, since this method of manufacturing requires a retractable core to form the axial opening in the bearing. Extra labor costs not only increase bearing costs but may prevent the manufacturer from molding the bearing in the United States. If the added labor costs make the price too high, the manufacture may resort to cheaper fabrication offshore to overcome the inefficiencies of molding.

Thus, the combination of the need for a high grade plastic for strength and the additional labor costs to mold plastic bearings with retractable cores result in plastic bearings that are relatively expensive to manufacture in the United States. However, an open-and-shut molding process to manufacture plastic bearings and an assembly process which does not require force on bearings could greatly reduce manufacturing costs.

The present invention solves the problem of making small-diameter plastic bearings domestically. Manufacturing the bearings of the invention is inexpensive. The invention uses bearings frictionally mounted in paint rollers that can have an internal diameter smaller than the conventional one- and one-half-inch diameter. An open-and-shut molding process results in one-piece bearing with a central opening. In addition, an offsetting relationship of the frictional support surfaces on the bearing diminishes the criticality of dimensional tolerances, thus allowing the inexpensive manufacture of small-diameter bearings that properly engage the interior of a paint roller core in a hand slip-on or manual arrangement. Open-and-shut molding considerably reduces labor costs of manufacturing one-piece bearings and an assembly process using a separate axle-engaging member greatly reduces the forces on the bearing during assembly on the paint roller frame. Consequently, manufacture of the bearings from inexpensive grades of plastics is feasible.

A preferred embodiment of this bearing housing creates the continuous axle core through an offsetting relationship of frictional support surfaces that require a simple open-and-shut mold design, one which does not require cores or slides. Another preferred embodiment uses oppositely positioned friction ridges to provide regions of higher frictional engagement between the bearing and the roller.

DESCRIPTION OF THE PRIOR ART

U.S. Pat. No. 3,877,123 shows a unitary molded paint roller core structure for rotatably mounting a paint sleeve thereto. To hold the core on the axle of the paint roller applicator, the invention provides a recess for securing means but discloses no roller core securing means.

U.S. Pat. No. 3,711,887 shows a paint roller applicator for attachment to an axle of a paint roller applicator with a collet bearing press fitted on the axle until the collet bearing engages stop lugs on the axle of the paint roller. Bearing sleeves on the roller sleeve appear to rotatingly engage the outside of the collet bearing.

U.S. Pat. No. 2,747,210 shows a cage mechanism which uses a collar with a set screw to prevent the cage mechanism from sliding off the end of the axle.

U.S. Pat. No. 3,228,087 shows a plastic roller cage with pleats to support a paint roller. A nut holds the roller on the axle of the paint roller.

U.S. Pat. No. 3,447,184 shows a paint roller axle with an expandable gripper mass to permit a user to adjust the tightness between the paint roller core and the gripper mass.

U.S. Pat. No. 4,209,883 shows a plastic molded roller cage of two parts that are joined together by an integral hinge with a cap-type washer to hold the roller cage on the axle of the paint roller.

U.S. Pat. No. 2,669,742 shows a split cylinder with ears to engage the end closure members of the paint roller applicator to provide drive for the roller.

U.S. Pat. No. 4,316,301 shows a neck on the axle to engage the end cap of a paint roller.

U.S. Pat. No. 3,386,119 shows a paint brush with a flared handle and bristles held in the flared end by a tubular metal ferrule.

U.S. Pat. No. 2,854,684 shows a flared handle with a ferrule to hold the bristles on the flared end of the brush handle.

U.S. Pat. No. Des. 291,152 shows an ornamental roller cover support for a paint roller.

BRIEF SUMMARY OF THE INVENTION

Briefly, the present invention comprises an improvement to paint roller bearings that permits a user to change the paint roller on a paint roller applicator quickly and efficiently. A one-piece bearing and a one-piece axle engaging member clamp to the axle of a paint roller frame to rotatably secure a bearing to the axle of the paint roller frame. A friction fit between the bearing and the interior cylindrical surface of a paint roller core permits axial sliding of a new paint roller onto the applicator. The bearing has offset surfaces to permit molding of a bearing with a central opening using an open-and-shut molding process that eliminates the need for a retractable core to form the center opening in the bearing.

BRIEF DESCRIPTION OF THE DRAWINGS

FIG. 10 shows an exploded view of a paint roller applicator with an axle-engaging means that fastens to the end of the axle of a paint roller;

FIG. 11 shows a partial sectional view of a large diameter paint roller applicator with the bearing of the present invention;

FIG. 12 shows a perspective view of an end cap axle-engaging member;

FIG. 13 shows a sectional view of the assembly of the bearing and end cap on the axle of a large-diameter paint roller applicator;

DESCRIPTION OF THE PREFERRED EMBODIMENT

Figure 1:
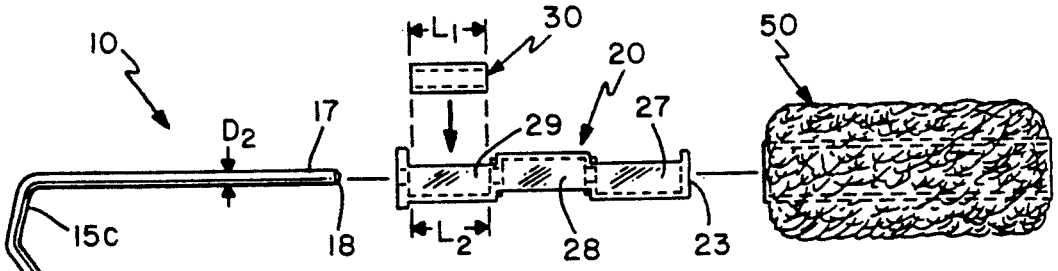
FIG. 1 shows an exploded view of a paint roller applicator showing the bearing mechanism for engaging the axle of the paint roller applicator and the core of a paint roller.

FIG. 1 shows an exploded view of our invention showing four component parts that can be assembled manually to produce a paint roller. The four components include a paint roller frame 10, an axle-engaging member 30, a bearing 20 and a paint roller 50. Bearing 20 comprises a one-piece housing and axle-engaging member 30 comprises a one-piece member that together provide a two-piece paint roller bearing assembly especially suitable for conventional paint rollers or paint rollers with inside core diameters smaller than one and one-half inch.

Refer to numeral 10 which identifies a paint roller frame with a handle 40 and a lip 41 for holding the paint roller frame on the edge of a paint tray. Paint roller frame 10 includes a cylindrical metal shaft 15, having a first end **15*a* secured to handle 40. The other end of shaft 15*a* connects to an offset section 15*b* that connects to an angled section 15*c* which connects to a cylindrical axle 17. Axle 17 is substantially perpendicular to handle 40 and has a diameter reference D2. The free end of axle 17 includes a beveled end surface 18 to simplify axial insertion of axle 17 into a central opening in bearing 20. The preferred material for fabrication of axle 17** is a rigid, nondeformable material, such as metal.

Bearing 20 includes a cylindrical, intermittent housing having a series of offset or staggered outer semi-cylindrical surfaces that frictionally engage a continuous cylindrical core in paint roller 50. A set of identical, end-to-end interior housing sections 27, 28 and 29 form housing 20 providing intermittent bearing surfaces for engagement of a continuous core in a paint roller. Housing 20 includes a central opening for rotationally engaging axle 17. The offset or staggered surfaces enable manufacture of housing 20 in an open-and-shut molding process without the use of retractable cores.

Figure 5:
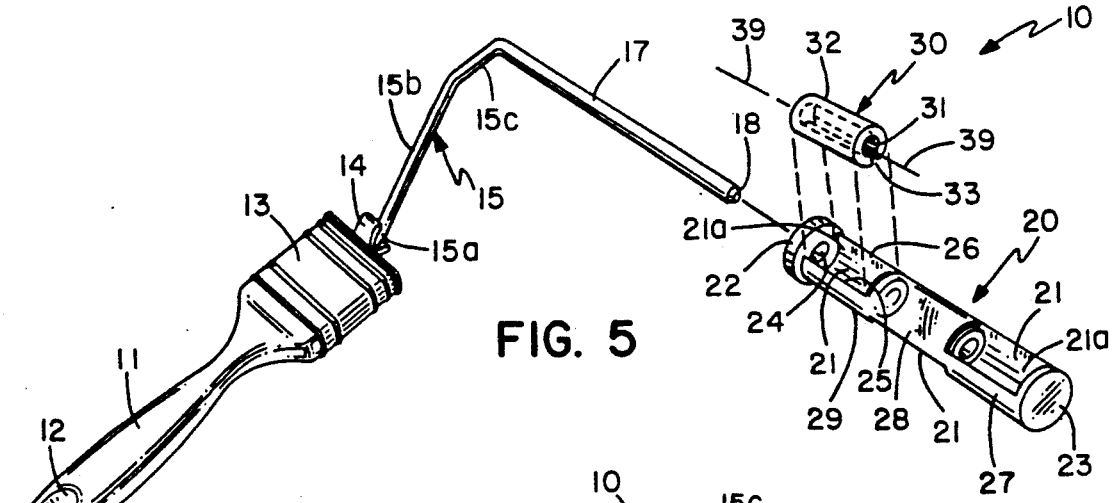
FIG. 5 shows an exploded perspective view of the paint roller frame of FIG. 4, together with a bearing for rotatably securing a paint roller to the axle of the paint roller applicator.
Figure 6:
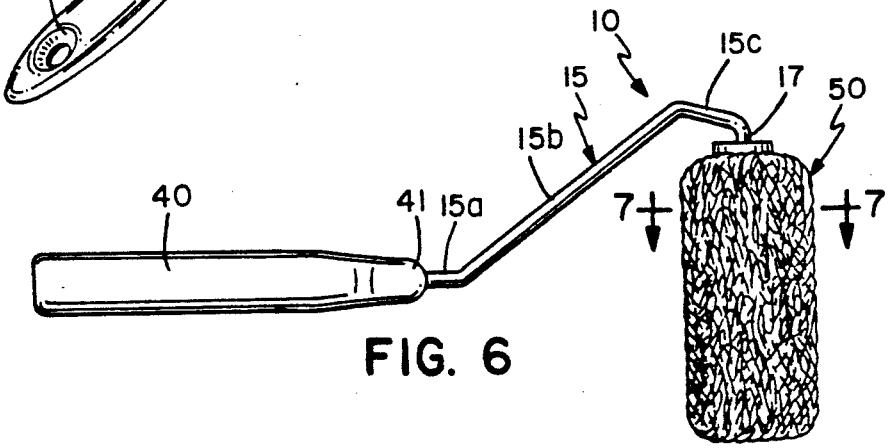
FIG. 6 shows an assembled view of the paint roller applicator of FIG. 1.
Figure 7:
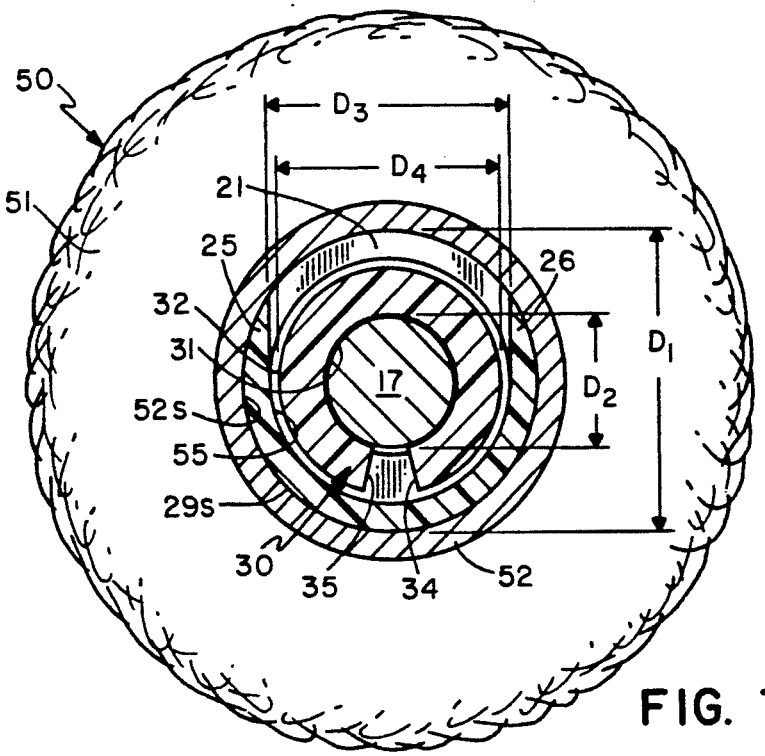
FIG. 7 shows an enlarged sectional view taken along lines 7—7 of FIG. 6.

Above bearing 20 is a cylindrical axle-engaging member 30 that loosely fits within the confines of one of the cylindrical chambers in bearing 20 and permits free rotation of bearing 20 about axle-engaging member 30 with axle-engaging member 30 clamped around axle 17. FIGS. 1, 5 and 7 show axle-engaging member 30 which consists of an annular sleeve 32 having an elongated opening 33 that extends parallel to a central axis 39 of axle-engaging member 30. A first end surface 34 extends along one side of opening 33 and a second end surface 35 extends along the opposite side of elongated opening 33. Axle engaging member 30 is made from a resilient material, such as a polymer plastic or rubber, to permit frictional engagement of axle-engaging member 30 to axle 17 with the resiliency inherent in axle-engaging member 30; that is, this invention requires no screws or special fasteners to securely hold axle-engaging member 30 on axle 17 once axle-engaging member 17 is clamped to the axle. Inside member 30 is a surface 31 that comprises the sole means to frictionally engage axle 17 to prevent axial or rotational movement of member 30 with respect to axle 17.

FIGS. 1 and 5 illustrate axle-engaging member 30 before assembly. FIG. 7 shows axle-engaging member 30 assembled, clamped with member 30 on axle 17, and firmly locked to axle 17; that is, diameter D2 of axle 17 is slightly larger then the inside diameter of axle-engaging member 30 when member 30 is preasembled or in the relaxed condition. Consequently, insertion of member 30 onto axle 17 expands member 30 radially to fit around axle 17. As a result, the inherent resiliency of axle-engaging member 30 places a continuous radial inward force against nondeformable axle 17. The resiliency of axle-engaging member 30 is sufficiently strong, so it clamps member 30 around axle 17. The clamping engagement prevents axial movement of member 30 with respect to axle 17. Preferably, the resiliency of axle-engaging member 30 should not be so great or strong that it prohibits manual assembly of axle-engaging member 30 onto axle 17; that is, squeezing axle-engaging member 30 into cylindrical chamber 21 and around axle 17 and then pushing the two members between the thumb and forefingers assembles the two-piece bearing on axle 17. In addition, the assembly of axle-engaging member 30 requires little force on housing 20.

Bearing 20 comprises a general cylindrical housing member which is particularly well suited for use with paint rollers having cores as small as one-half inch diameter; that is, the conventional bird-cage mechanisms used in larger rollers do not function well if the inside diameter of the paint roller applicator is less than one-and one-half inches. Making bird-cage mechanisms which function properly with smaller diameter paint rollers or mini-rollers is relatively costly. The present invention provides an inexpensive bearing for both forming rotatable engagement with an axle of a paint applicator frame and frictionally holding a paint roller on the bearing while still permitting the user to change paint rollers manually.

FIG. 5 shows that bearing 20 comprises a first end cap 23 with a central opening 24 that is slightly larger than diameter D2 of axle 17 to permit free rotation of housing 20 about axle 17. Located end to end in housing 20 are a series of semi-cylindrical housing sections 27, 28, and 29, each containing a chamber 21. Each of sections 27, 28, and 29, molded using an open-and-shut process, includes an elongated tapered lip 25 on one side and an elongated tapered lip 26 on the opposite side of chamber 21*a*. A rectangular elongated opening 21*a* extends across each of housing sections 27, 28, and 29 to provide access for insertion of axle-engaging member 30. FIG. 5 shows the end-to-end relationship of housing sections 27, 28 and 29 with the openings of each adjacent housing oppositionally facing the adjacent housing and offseting or staggering engagement with the interior of a core of a paint roller. While FIG. 5 shows multiple chambers, generally only one chamber is used with a single axle-engaging member. However, placement of axle-engaging members in additional chambers provides greater holding force.

FIG. 7 shows spacing of lips 25 and 26 denoted by D3. Note that diameter D3 is greater than the outside diameter D4 of member 30 which clamps to axle 17. The use of an outside diameter on member 30 that is less than the inside diameter D4 permits one to radially insert member 30 into chamber 21 and around axle 17 as illustrated by the arrows and dotted line in FIG. 1. The radial spacing between the exterior of member 30 and chamber 21 also permits bearing 20 to rotate freely about axle-engaging member 30 and axle 17.

FIG. 7 also shows that the manufacturer can use an open-and-shut molding process to fabricate the internal chambers with the maximum inside diameter D3 at the top of the chamber.

FIG. 1 shows that length L1 of member 30 is sufficiently smaller than length L2 of chamber 21. The reason for this is to prevent bearing 20 from binding on axle-engaging member 30 as housing 20 rotates around member 30. Length L1 of axle-engaging member 30 which is slightly shorter than chamber 21 combined with a diameter that is slightly smaller than chamber 21 permits housing 20 to rotate freely about axle 17, while preventing substantial longitudinal displacement of bearing 20 along axle 17.

Figure 2:
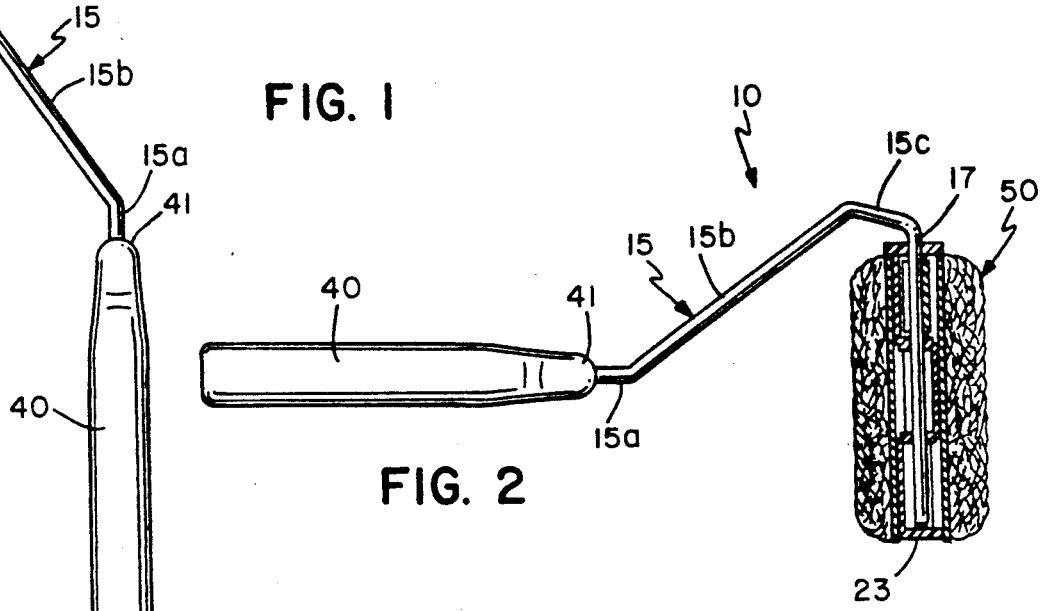
FIG. 2 is an assembled, partial sectional view of a paint roller applicator of FIG. 1
Figure 3:
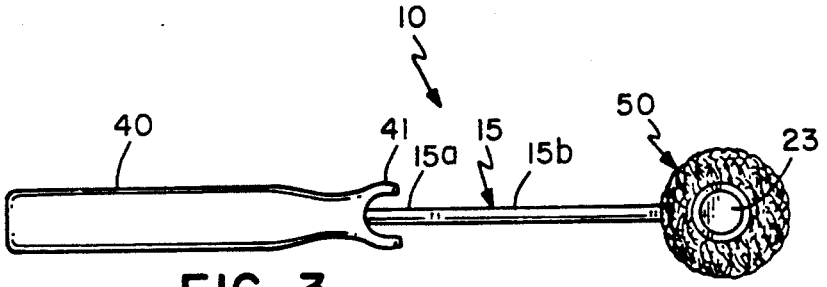
FIG. 3 shows a side view of the paint roller applicator of FIG. 1.

To assemble manually the components into a paint roller applicator, a user grasps frame 10 and axially slides axle 17 into central opening 24 in bearing 20. He or she then radially pushes axle-engaging member 30 into chamber 21 and snaps it around axle 17. This assembly procedure requires almost no force on housing 20 to assembly housing 20 on axle 17. To complete the assembly, a user axially slides paint roller 50 having a cylindrical core 52 on the outside of bearing 20. FIG. 2 illustrates a top view of a fully assembled paint roller applicator partially in section; FIG. 3 illustrates a side view of a fully assembled paint roller applicator.

Note that the co-action of axle-engaging member 30 and bearing 20 provide rotational engagement of bearing 20 with respect to axle 17. FIG. 7 shows a cross section of paint roller 50, having an outer annular paint applicator portion 51 with a cylindrical paint roller core section 52 that has an inner continuous cylindrical surface 52*s* that frictionally engages the outer surfaces of bearing 20. The frictional engagement of exterior semi-cylindrical surface 29*s* and identical counterparts on housing 20 with core inner surface 52*s* frictionally holds paint roller core 52 on housing 20 to permit a user to roll paint on a surface. Since only frictional forces hold core 52 on bearing 20 a user can easily replace a paint roller on housing 20 by sliding a paint roller on housing 20. In general, the frictional holding force produced by the clamping action of the axle-engaging member 30 is greater than that produced between the core and the bearing, thereby permitting a user to slide a paint roller off the bearing without removing the bearing from the axle of the paint roller frame.

Figure 8:
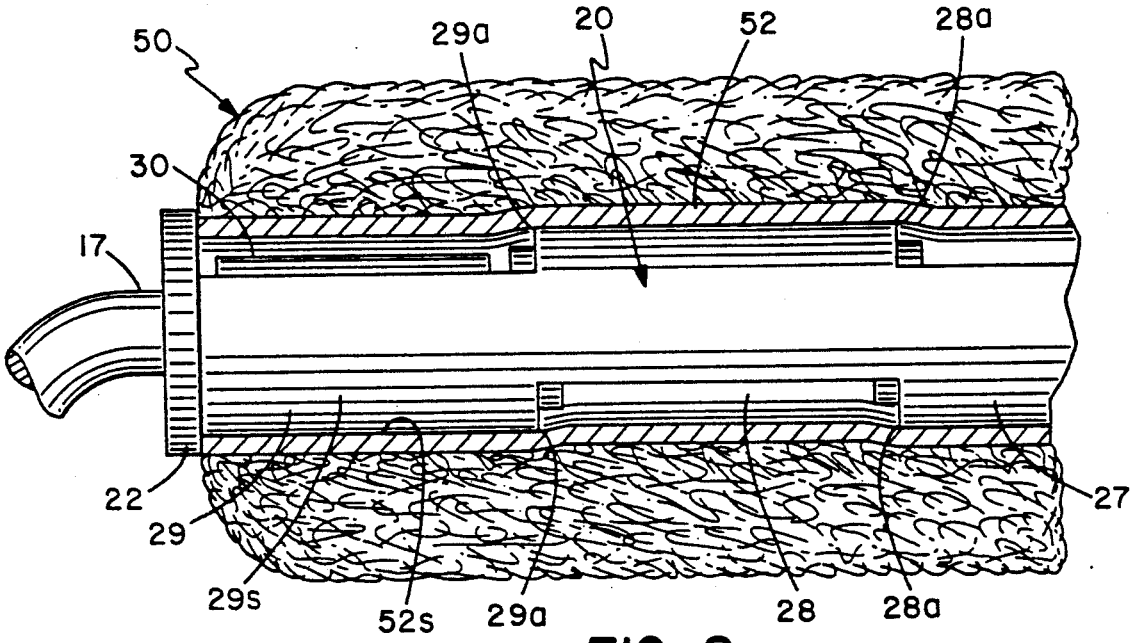
FIG. 8 shows an enlarged and exaggerated view of the bearing engaging a paint roller core.

To understand a further frictional feature provided by the alternate arrangement of interior housing sections 27, 28, and 29, refer to FIG. 8, which shows paint roller 50 with core 52 on housing 20. FIG. 8 is greatly exaggerated to illustrate the use of edges of alternate chambers with offsetting surfaces provide a firm gripping engagement with the interior of core surface 52*s*. Note semicircular lip 29*a* on bearing 20 and semicircular lip 28*a* on bearing 20 create areas of different frictional engagement along the interior of roller core 52; that is, the top portion of housing 20 that includes the open area above housing section 29 does not apply pressure against roller surface 52*s* while the section adjacent to portion of housing section 28 applies pressure against roller surface 52*s*. Likewise, the top portion of housing section 27 does to apply pressure against roller surface 52*s*. It shows that the diametrically opposite, alternate facing engagement of roller surface 52*s* provides a slight stress or higher pressure region to help prevent core 52 from sliding off housing 20 FIG. 8 exaggeratedly illustrates the appearance of the frictional-locking fit produced at the edges of the chambers to help prevent axial displacement of core 52 during normal use in applying paint to a surface. In addition, the offset or staggered surfaces reduce the close tolerances required to produce a frictional fit because the bearing has minimal regions where the bearing exterior surface is in 360-degree contact with an interior surface of the paint roller core.

Figure 9:
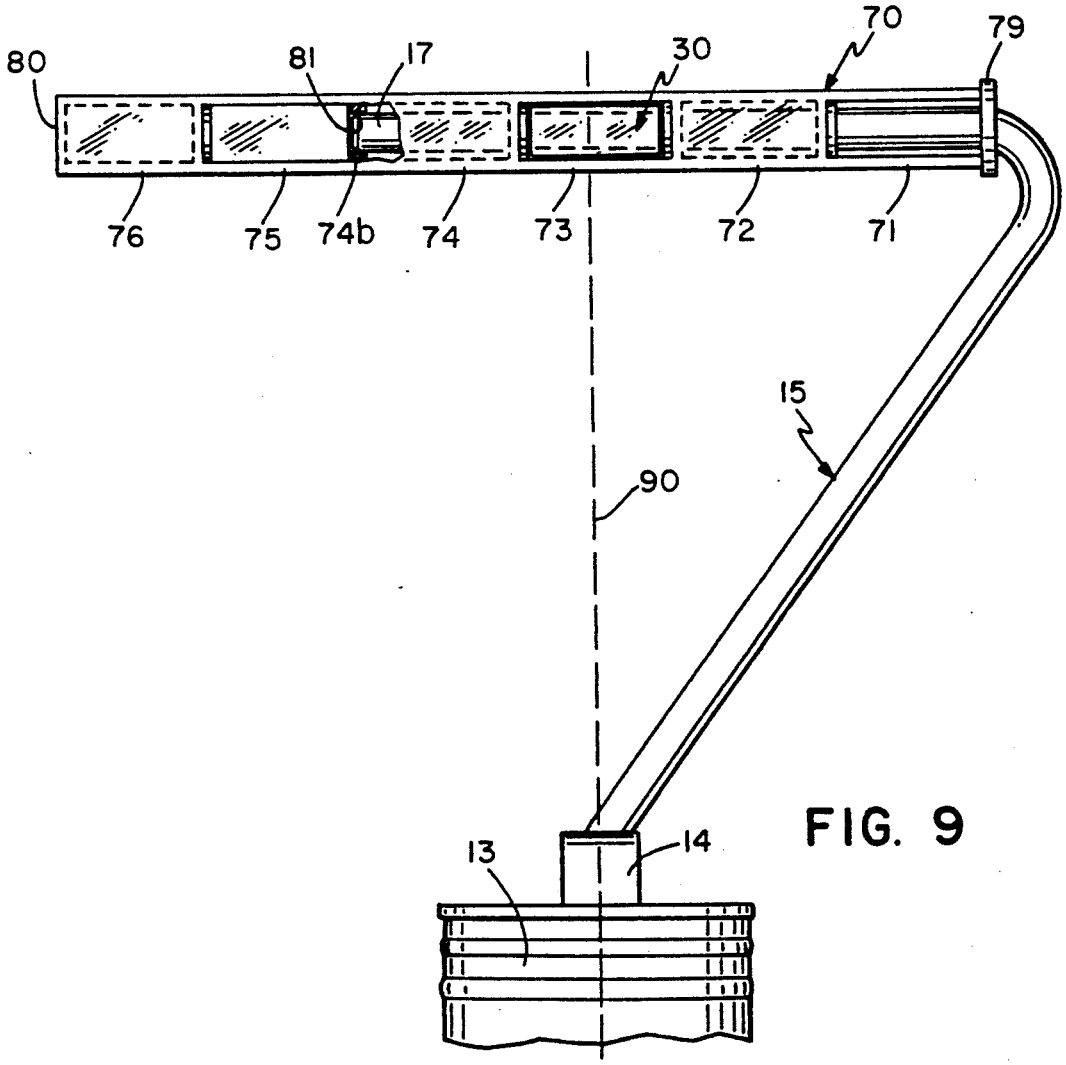
FIG. 9 shows a paint roller frame with a bearing that extends beyond the end of the axle of the paint roller frame.

FIG. 9 illustrates an alternate bearing 70, with housing sections 71, 72, 73, 74, 75, and 76 end-to-end. Bearing 70 is identical to bearing 20, except that bearing 70 has additional chambers and extends beyond the end of axle 17. Note the bearing 70 is asymmetrical with respect to an axis 90 through metal ferrule 13 and holder 14. A central opening extends through bearing 70, except for the closed end cap 80 which prevents paint from getting into the bearing. On one end of bearing 70 is an annular ridge 79 that acts as a stop for a paint roller core. An axle-engaging member 30 holds bearing 70 in a rotatable position on axle 17.

One of the features of our bearing 70 is that a user can install different length bearings with the same length axle on a paint roller frame. Consequently, a user can insert a different length roller on a paint roller frame. For example, a user might be using a four-inch long roller with our frame and then decide that a longer roller would be more useful. He or she could then slide off the shorter bearing and replace it with a six-inch long bearing, even though a portion of the bearing extends in an unsupported fashion past the end of axle 17.

Figure 4:
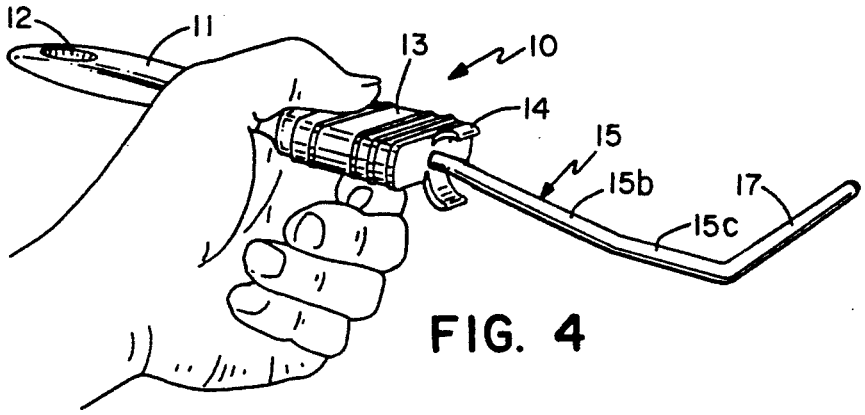
FIG. 4 shows a perspective view of a paint roller frame and handle for use with a bearing mechanism of FIG. 1.

FIG. 4 shows a conventional paint brush handle having an elongated flat section covered with a metal ferrule 13 and a tapered neck portion 11 for a user to grasp.

FIG. 10 shows a mini-paint roller applicator 140 with a conventional handle 141. A wire frame 142 connects handle 141 to a transverse axle 144. A rotatable bearing 143 is mounted on cylindrical transverse axle 144. Bearing 143 is virtually identical to bearing 20, except that bearing 143 includes four chambers instead of three. To prevent bearing 143 from sliding laterally on axle 144, an end cap 120 forms a tight frictional fit on the end of axle 144; that is, a user pressing end cap 120 on axle 144 creates a durable, frictional grip on axle 144, so that the frictional holding force of end cap 120 is greater than the frictional forces holding a paint roller core on bearing 143. The use of a stronger holding force between end cap 120 and axle 119 than between the core of a paint roller and the exterior of the bearing allows a user to exchange rollers without displacing the bearing. The holding force between the core and the bearing should be sufficiently low so that a person can grasp the paint roller in one hand and, with the other hand, grasp frame 142 and slide the paint roller 150 on or off axle 144. The frictional force should be sufficiently strong so that the roller does not slip off during application of paint to a surface. Consequently, with the present invention, a user can quickly and easily exchange a soiled roller for a fresh roller without disturbing the axial position of the bearing on the axle; yet he or she can attach the bearing on the axle by applying axial pressure on the end of the bearing. The manufacturer can determine the proper frictional forces for an application required by the dimensional differences between two surfaces through trial and error since they will be a function of variables such as the diameter and the materials used for the bearing.

FIG. 11 shows our mini-roller bearing adapted for a conventional large diameter paint roller applicator 95 which has a housing 100 with a typical outside diameter of one-and-one-half inches and a length of nine inches. Paint roller applicator 95 has a handle 96 with a wire frame 97 extending upward to a transverse axle 119 with a diameter D6. Bearing 100 comprises a series of substantially semi-cylindrical sections 101, 102, 103, 104, 105, 106, 107, 108, and 109 located end-to-end. FIG. 11 shows exterior semi-cylindrical surfaces on one side of housing identified by reference 102*s*, 104*s*, 106*s*, and 108*s*. Similarly, semi-cylindrical housings corresponding to sections 101, 103, 105, 107, and 109 are diametrically opposite housing 100. The exterior semi-cylindrical surfaces of each of the semi-cylindrical sections offset one another, so that the exterior surfaces of housing 100 intermittently engage the continuous cylindrical core 130 of paint roller 131. Bearing 100 comprises a one-piece housing that is made from a polymer plastic or the like. On the end of bearing 100 is a cylindrical end cap 101*a*; on the other end is a cylindrical end cap 111 having a central opening 111*b*. Between each of the semi-cylindrical sections is a cylindrical divider that has a central opening therein to permit housing 100 to rotate freely around axle 119. Reference numerals 102*a*, 103*a*, 104*a*, 105*a*, 106*a*, 107*a*, 108*a* and 109*a* are cylindrical dividers. Typically, the width of the cylindrical dividers is approximately 1/10 of an inch. The purpose of having a small width to the dividers is to provide regions of diametrical support at axially spaced locations along the core of the paint roller, while still maintaining substantially all the bearing exterior surfaces with no diametrically opposite supporting surfaces. This design greatly reduces the need to maintain close dimensional tolerances between the inside of a paint roller core and the exterior of the bearing since the number of rigid regions that must engage one another is minimal.

FIG. 13 provides greater detail of bearing 100 assembled on axle 119. FIG. 13 also illustrates the offsetting relationship of exterior semi-cylindrical surfaces 101*s* and 102*s*, as well as the offsetting relationship of exterior semi-cylindrical surface 102*s* and 103*s* which forms a frictional fit but prevents the bearing 100 from binding the paint roller core without having to closely control the tolerances of both the housing and the core.

FIG. 12 shows an alternate embodiment of an axle-engaging member comprising a resilient cylindrical cap 120 made from a polymer plastic or a similar material. Cap 120 has an interior chamber 121 that fits around the end of axle 119. On the interior of cap 120 is a cylindrical surface that frictionally engages the end of axle 119. Cylindrical end cap 120 has a length L5 and an inside diameter D5. Length L5 of end cap 120 is slightly less than length L6 of the chamber in section 101, so that bearing does not bind against end cap 120 as it rotates around axle 119. The internal diameter D5 of end cap 120 is slightly smaller than the axle diameter D6, so that a user must firmly press end cap 120 onto axle 119. FIG. 13 illustrates radial expansion of end cap 120 as a user forces it onto the end of axle 119. Once in place, end cap 120 firmly engages axle 119 to prevent lateral displacement of housing 100 on axle 119. The dimensional differences and the material used to manufacture end cap 120 determine the amount of force required to remove or place end cap 120 on axle 119. In general, the frictional fit between end cap 120 and axle 119 should be sufficient to prevent a user from pulling off the end cap when changing rollers on the bearing.

Figure 14:
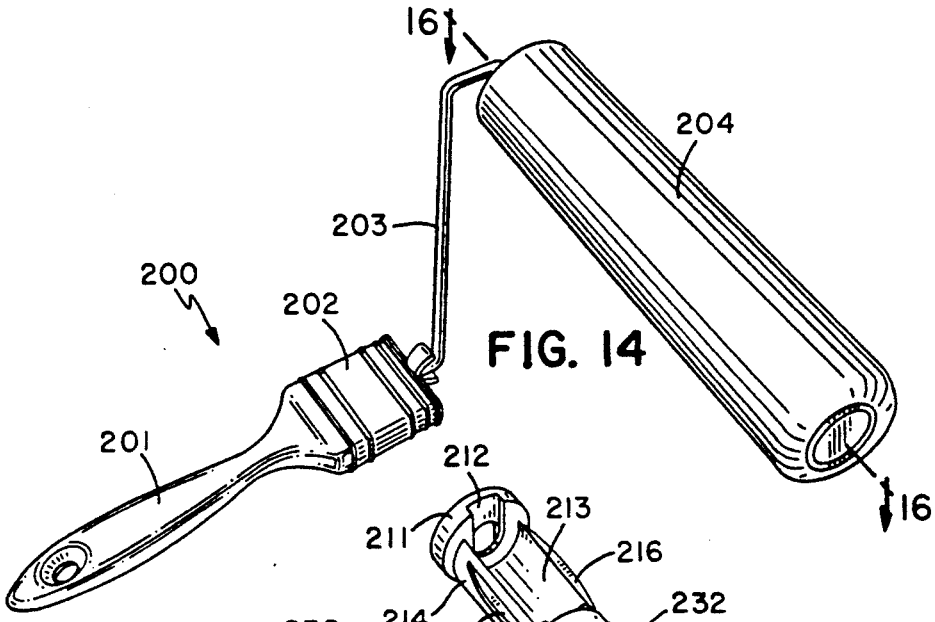
FIG. 14 shows a perspective view of a paint roller with our bearing mechanism.
Figure 15:
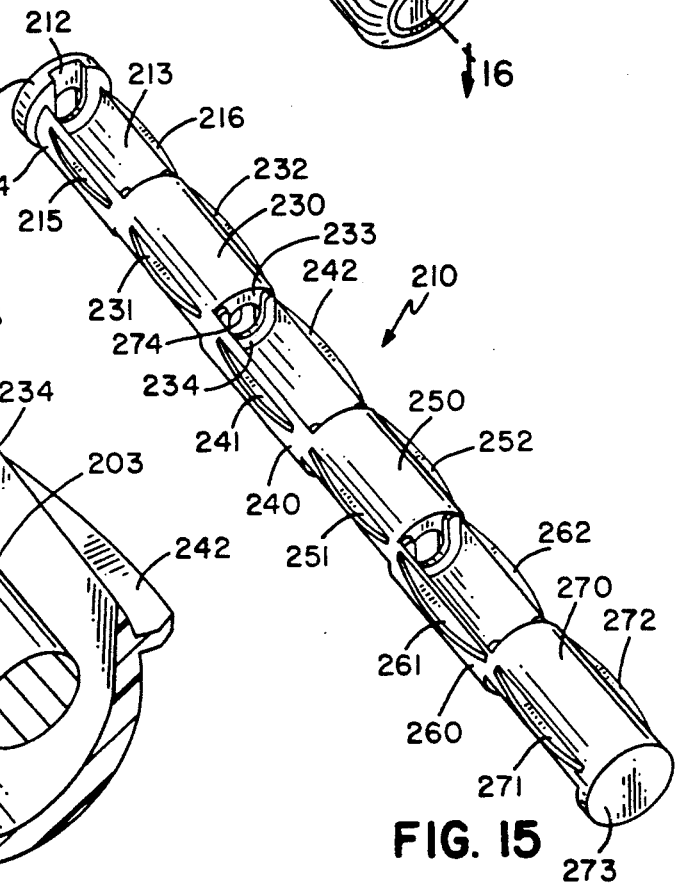
FIG. 15 shows a perspective view of our bearing mechanism.
Figure 16:
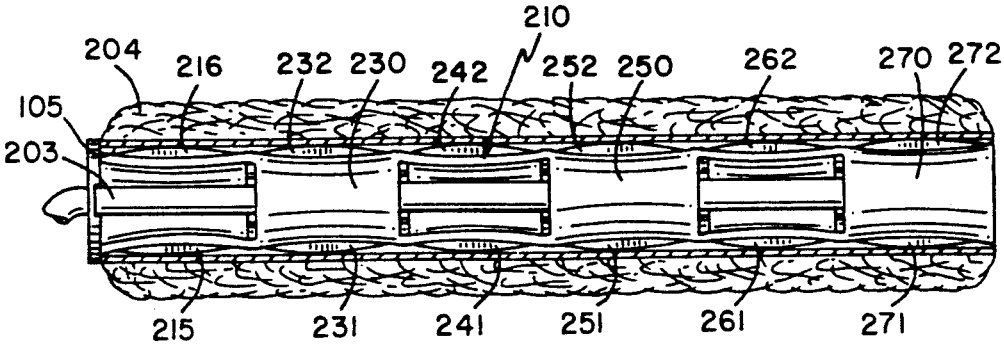
FIG. 16 shows a sectional view taken along lines 16—16 of FIG. 14.

FIG. 14 reference numeral 200 identifies a paint roller applicator with a beaver tail handle 201, a base 202, a wire frame 203 with a roller 204 rotatably mounted on frame 203. FIG. 16 shows a sectional view taken along line 16—16 of FIG. 4 that reveals the frictional engagement of housing 210 and roller 204, with housing 210 rotatably mounted on frame 203. FIG. 15 shows a perspective view of housing 210 made through the process of open-and shut-molding without the aid of cores or slides. Housing 210 includes an end cap 211 having a slot 212 formed by the top portion of the mold. Housing 210 includes a first semi-cylindrical section 214 having a semi-cylindrical chamber 213 therein. On one side of chamber 213 is an arc-shaped core engaging member 215 for engaging an axial portion of a paint roller core. Similarly, on the opposite side is a second arc shaped core-engaging member or friction ridge 216 for engaging an axial portion of a paint roller core on the diametrically opposite side from member 215. Friction ridges 215 and 216 are arc shaped so that a user can slide the roller core onto members 215 and 216 without catching the roller on the end of the friction ridges. Since members 215 and 216 are at the open end of chamber 213, the walls of section 214 provide resiliency and permit inward flexing of members 215 and 216. FIG. 16 best illustrates this feature; it shows members 215 and 216 forcing the walls of section 214 inward with the outside edge of members 215 and 216 engaging the inside of core 205.

Similarly, semi-cylindrical sections 230 have a first arc-shaped core-engaging member or friction ridge 231 and a second arc-shaped core-engaging member or friction ridge 232 for engaging the core of a roller. Sections 240, 250, 260, and 270 are identical; each has a pair of arc-shaped core-engaging members or friction ridges. Section 240 includes arc-shaped core-engaging members or friction ridges 231 and 232. Section 250 includes arc-shaped core-engaging members or friction ridges 251 and 252. Section 260 includes arc-shaped core-engaging members or friction ridges 261 and 262. Similarly, end section 271 includes arc-shaped core-engaging members or friction ridges 271 and 272 together with end cap 273.

Figure 17:
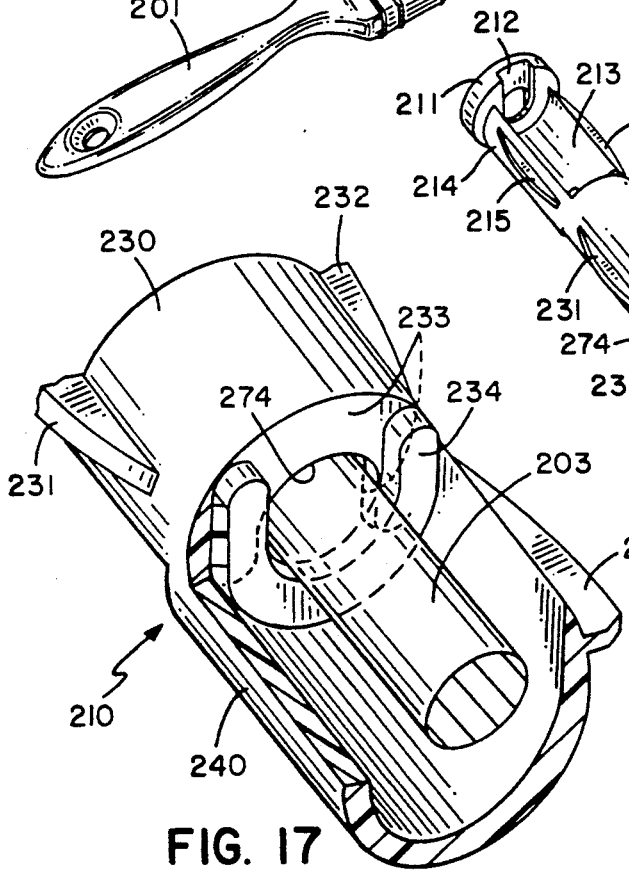
FIG. 17 shows an enlarged partial sectional view of our bearing mechanism.

To illustrate that manufacturing housing 210 without cores or slides is possible, FIG. 17 shows an enlarged portion of housing 210 around axle 203. The opening for axle 203 is in a central opening 274 formed partially by one end 233 of section 230 and partially by end 234 formed in section 240. Note the open end of U-shaped end section 233 faces downward and the open end of U-shaped end section 234 faces upward. With the two end sections facing opposite directions, the co-action of the two end sections produces a central opening 274 in housing 210. Similarly, each of the adjacent sections includes opposite facing U-shaped sections to provide a central opening for housing 210 to rotate around axle 203.

Figure 20:
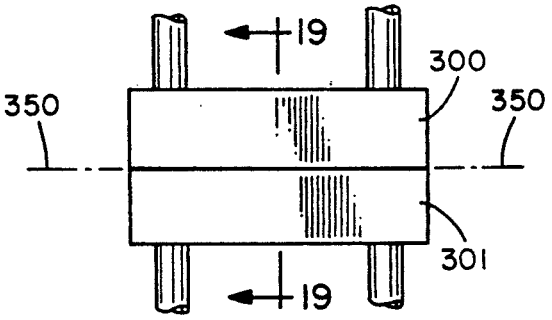
FIG. 20 shows an end view of a two part open and shut mold.

To illustrate the open-and-shut molding process of housing 210, refer to FIG. 20 which shows a two-part mold having an upper mold 300 and a lower mold 301 that meet along a part line 350.

Figure 18:
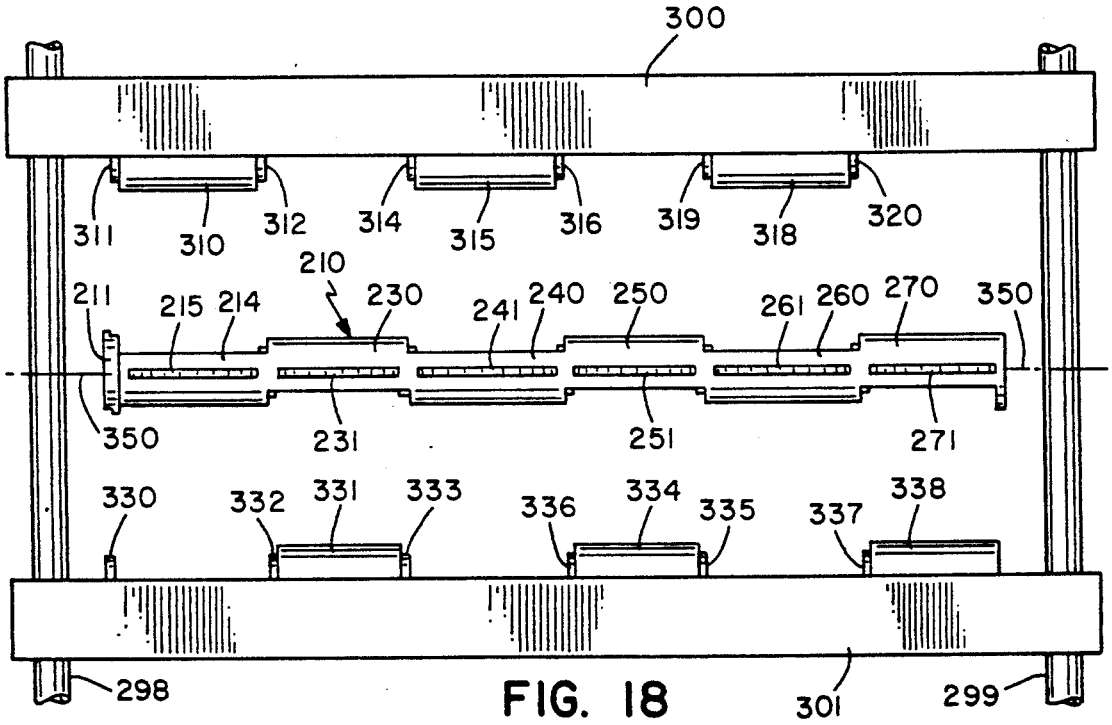
FIG. 18 shows a two-part mold for forming the bearing mechanism in the open position.

FIG. 18 shows mold 300 and mold 301 spaced equidistant from one another. A pair of rods 298 and 299 extends through the molds on each side and holds the molds in register. Part line 350 extends through a molded bearing 210. On upper mold 300 are semi-cylindrical male protrusions 310, 315 and 318. Protrusion 310 has U-shaped end portions 311 and 312 which form the U-shaped end portions of section 214. Semi-cylindrical protrusion 315 has end portions 314 and 316 which form the U-shaped end portions of section 240. Note that U-shaped member 314 forms end member 234 illustrated in FIG. 17. Semi-cylindrical protrusion 318 has end portions 319 and 320 which form the U-shaped end portions of section 260. Bottom mold 301 contains identical semi-cylindrical portions 331, 334, and 338 that form respectively portions of sections 230, 250 and 270. On the end is a male U-shaped member 330 that forms a portion of the opening in the end of housing 210.

Figure 19:
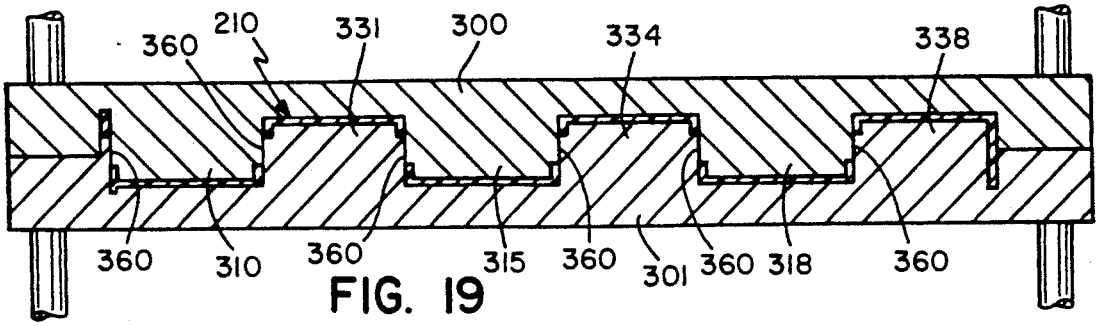
FIG. 19 shows the two-part mold of FIG. 18 in the closed position.

To better understand the mating of mold 300 with mold 301 in an open-and-shut molding process, refer to FIG. 19 which shows mold 300 and mold 301 sandwiched around housing 210. FIG. 19 shows that molds 300 and 301 have contact areas 360 at the end portion of each mold section. Areas 360 create a void for forming one-half of the central opening for the axle in each end portion of the sections.

The method of making a housing for a paint roller bearing using an open and shut molding process comprises the steps of forming a top mold with first U-shaped projections 310, 315, and 318. with each having a U-shaped end surfaces. FIG. 18 shows U-shaped end surfaces 311 and 312 on projection 310; U-shaped end surfaces 314 and 316 on projection 315; and U-shaped end surfaces 319 and 320 on projection 318. One then forms a bottom mold with a second U-shaped projections 331, 334, and 338 with each having U-shaped end surfaces. FIG. 18 shows U-shaped end surfaces 332 and 333 on projection 331; U-shaped end surfaces 335 and 336 on projection 334; and U-shaped end surfaces 337 on projection 338. By positioning U-shaped end surfaces of the top and bottom molds so that the end surfaces on adjoining protrusions are substantially the same plane causes the U-shaped end surfaces to partially contact each other. In the regions of contact denoted by reference numeral 360 in FIG. 19 provides a central region to exclude moldable material. The result is that central contact region forms an opening between an object molded from top mold 300 and bottom mold 301. To complete the molding of our bearing one flows a moldable plastic into the cavity formed by top mold 300 and bottom mold 301 to mold our paint roller bearing housing 210. After molding one separates top mold 300 from bottom mold 301 to produce a ready to use paint roller bearing housing 210 with a central opening extending therethrough that is formed by the contact regions 360 of mold 300 and 301. If desired one can also mold friction ridges into the bearing by locating the friction ridges along the mold part line 350.

While this specification shows the invention for use with cylindrical rollers, other rollers such as corner rollers and the like are equally well suited for use with our invention.

We claim:

1. A paint roller bearing for rotatably supporting a paint roller on the axle of a paint roller applicator comprising:

a one-piece bearing housing having a central axis, said bearing housing having a partial cylindrical chamber therein, said bearing housing having a central opening extending therethrough to permit said bearing housing to rotate freely around an axle of a paint roller frame, said bearing housing having an outer surface for engaging an interior surface of a paint roller to hold a paint roller on said bearing housing, said partial cylindrical chamber having a length L2 and an interior diameter D3, said bearing housing made from a rigid material with said bearing housing having exterior partial cylindrical surfaces for intermittently engaging the core of a paint roller, with each of said exterior partial cylindrical surfaces having substantially no corresponding diametrically opposite partial cylindrical surface for engaging the core of a paint roller; and an axle-engaging member, said axle-engaging member located in said partial cylindrical chamber, said axle-engaging member having a length L1 and an exterior diameter D4, said axle-engaging member comprising a resilient material to permit frictional mounting of said axle-engaging member on the axle of a paint roller frame, so that the co-action between said partial cylindrical chamber and said axle-engaging member prevents said bearing housing from substantial lateral displacement but permits said bearing housing to rotate freely around the central axis extending through said bearing housing.

2. The paint roller bearing of claim 1 wherein said bearing housing partial cylindrical surfaces are offsetting partial cylindrical surfaces for frictionally and intermittently engaging the interior of a paint roller core to frictionally hold the paint roller core on said bearing housing.

3. The paint roller bearing of claim 1 wherein said axle-engaging member comprises a resilient cylindrical member having a central opening to permit placement of said axle-engaging member on the axle of a paint roller.

4. The paint roller bearing of claim 1 wherein said axle-engaging member has a cylindrical shape with an axial opening therein, said axle-engaging member including an elongated opening extending along said axle-engaging member to permit the user to mount said axle-engaging member on the axle of a paint frame roller by forcing the axle of a paint roller into the elongated opening in said axle-engaging member.

5. The paint roller bearing of claim 1 wherein said bearing housing includes a plurality of partial cylindrical chambers in an end-to-end relationship.

6. The paint roller bearing of claim 1 wherein said partial chamber length L2 is greater than said axle-engaging member length L1, and said axle exterior diameter D4 is less than said partial chamber interior diameter D3, to permit said axle-engaging member to prevent axial displacement of said bearing housing while permitting axial rotation around the central axis of said housing.

7. The paint roller bearing of claim 1 wherein said bearing housing and said axle-engaging member are made of polymer plastic.

8. The paint roller bearing mechanism of claim 1 wherein said bearing housing has an outside diameter of about one-half inch.

9. The paint roller bearing of claim 1 including an end cap on said bearing housing.

10. The paint roller bearing of claim 1 including friction ridges for frictional engaging a paint roller core with a force sufficient force to hold said paint roller core on said bearing but not sufficient to prevent a user from manually sliding said paint roller core on or off said bearing.

11. The paint roller applicator of claim 10 wherein said handle comprises a paint brush handle.

12. The paint roller applicator of claim 10 wherein said axially staggered partial cylindrical surfaces are semi-cylindrical.

13. A paint roller applicator for applying paint to a surface by rolling a paint-containing roller over the surface comprising:

a paint roller frame, said frame having a first end and a second end;

an axle attached to said first end of said frame for receiving a bearing housing;

a handle attached to said second end of said paint roller frame; and a bearing housing having a central axis, said bearing housing rotatably mounted on said axle, said bearing housing having axially staggered partial cylindrical surfaces for providing only axially staggered support to a paint roller located thereon.

14. A two-piece mini-paint roller bearing for rotatably supporting a paint roller on the axle of a paint roller applicator comprising:

a bearing housing having a central axis, said bearing housing having a semi-cylindrical chamber of a first length therein, said bearing housing having a central opening extending therethrough to permit said bearing housing to rotate freely around an axle of a paint roller applicator, said bearing housing having outer partial cylindrical surfaces for frictionally engaging alternate axial portions of an interior surface of a paint roller to frictionally hold a paint roller on said bearing housing to permit a user to slide said paint roller off said bearing housing with hand pressure; and an axle-engaging member, said axle-engaging member located in said semi-cylindrical chamber, said axle-engaging member having a length slightly less than the length of said chamber to form an axial stop to permit said bearing housing to rotate freely around said axle-engaging member, said axle-engaging member comprising a resilient material to permit frictional engagement of said axle-engaging member on the axle of a paint roller applicator so that the co-action between said semi-cylindrical chamber and said axle-engaging member prevents said bearing housing from substantial lateral displacement during use of a paint roller applicator, but permits said bearing housing to freely rotate around the central axis extending through said bearing housing, with the frictional force holding said axle-engaging member on an axle of a paint roller applicator being greater than the frictional force holding a paint roller on said bearing housing so a user can manually change a roller from said bearing housing without displacing said bearing housing with respect to an axle on a paint roller applicator.

15. A paint roller bearing for rotatably supporting a paint roller on the axle of a paint roller applicator comprising:

a bearing housing having a central axis, said bearing housing having at least two partial cylindrical sections therein, said bearing housing having a central opening extending therein to permit said bearing housing to rotate freely around an axle of a paint roller frame, said bearing housing having at least two outer axially staggered partial cylindrical surfaces for frictionally engaging axial offset portions of an interior surface of a paint roller to frictionally hold a paint roller on said bearing housing with sufficiently low force to thereby permit a user to slide said paint roller off said bearing housing using hand pressure, yet with sufficiently high force to prevent slippage of a paint roller on said bearing housing during normal use.

16. The paint roller bearing of claim 15 wherein said bearing housing has a diameter approximately one-half inch.

17. The paint roller bearing of claim 15 wherein said bearing housing has a diameter of approximately one- and one-half inches.

18. The paint roller bearing of claim 15 wherein said bearing housing comprises a single piece of material.

19. The paint roller bearing of claim 15 including friction ridges on said housing for frictionally holding a paint roller core on said bearing.

20. The paint roller bearing of claim 19 wherein said friction ridges are located parallel to said central axis.

21. The paint roller bearing of claim 20 wherein said friction ridges are located in diametrical opposite sides of said partial cylindrical sections.

22. The paint roller bearing of claim 21 wherein said friction ridges have an arcuate shape.

23. The paint roller bearing of claim 21 wherein said partial cylindrical sections include tapered lips and said friction ridges are located on said tapered lips to permit inward flexing of said friction ridges in response to pressure from the core of a paint roller.

24. The paint roller bearing of claim 23 wherein said friction ridges are molded in said bearing housing to provide a paint roller bearing housing of unitary one piece construction.

* * * * *